US005154298A

United States Patent [19]

Warner et al.

[11] Patent Number: 5,154,298

[45] Date of Patent: Oct. 13, 1992

[54] SYSTEM FOR SORTING PICKLE CHIPS AND THE LIKE

[75] Inventors: Robert L. Warner, Newport Beach; Harvey J. Kramer, Fontana, both of Calif.

[73] Assignee: Vlasic Foods, Inc., Farmington Hills, Mich.

[21] Appl. No.: 731,091

[22] Filed: Jul. 17, 1991

[51] Int. Cl.[5] ..... B07C 5/36

[52] U.S. Cl. ..... 209/616; 83/932; 209/688

[58] Field of Search ..... 209/615, 616, 688, 698, 209/689; 83/27, 932

[56] References Cited

U.S. PATENT DOCUMENTS

| | | | |
|---|---|---|---|
| 1,416,585 | 5/1922 | Stables . | |
| 1,743,240 | 1/1930 | Ryder | 209/616 |
| 2,991,882 | 7/1961 | Duplantis et al. . | |
| 3,024,903 | 3/1962 | Jamal | 209/688 X |
| 3,696,925 | 10/1972 | Harper . | |
| 4,123,289 | 10/1978 | Bourgeois . | |
| 4,207,986 | 6/1980 | Cerroni | 209/616 |
| 4,484,684 | 11/1984 | Tetreault | 209/616 |
| 4,699,275 | 10/1987 | Holsonbake | 209/616 |

FOREIGN PATENT DOCUMENTS

| | | | |
|---|---|---|---|
| 553226 | 6/1922 | France | 209/688 |
| 617875 | 2/1927 | France | 209/688 |
| 1456046A | 2/1989 | U.S.S.R. | 209/616 |
| 1479101A | 5/1989 | U.S.S.R. | 209/616 |
| 2200058A | 7/1988 | United Kingdom | 209/616 |

*Primary Examiner*—Donald T. Hajec

*Attorney, Agent, or Firm*—Banner, Birch, McKie & Beckett

[57] ABSTRACT

A system for mechanically sorting pickle chips with holes from those without holes. Pickle chips with holes are hooked on rotating hooks, separated out, gravity dropped off the hooks and conveyed to a location where they are processed into relish. The hooks face in direction opposite to their rotation and away from the chip infeed direction. The pickle chips without holes (the good chips) are accordingly not hooked and are sent to another location where they are packaged as pickle chips.

24 Claims, 6 Drawing Sheets

SYSTEM FOR SORTING PICKLE CHIPS AND THE LIKE

BACKGROUND OF THE INVENTION

The present invention relates to mechanical equipment for sorting food items. It further relates to systems and equipment for handling and processing pickle chips and the like.

Pickles are typically made from cucumbers which are soaked in either a brine, vinegar or spicy solution. They can be made into chips by cutting the cucumber perpendicular to the longitudinal axis. All cut pickle chips are not perfect though, as some have holes or open centers, that is, they consist essentially only of their rinds. People usually find these chips to be unacceptable for use in their hamburger or other sandwiches. Therefore, it is preferable to separate out the "defective" pickle chips from the good chips before packing them. The defective pickle chips can then be processed into pickle relish, if desired.

In the past, the defective pickle chips were separated out by hand, after having been cut into chips and prior to packing. This was a labor-intensive and thus costly process requiring workers to stand by conveyors and to sort the chips manually to pick out the defective chips. Often, these inspectors had to insert their hands into a layer of chips several inches deep as it moved by on an inspection belt, after discharge from a shaker bed. Thus, due to the number of chips that had to be sorted manually there was always the possibility for human error.

SUMMARY OF THE INVENTION

Accordingly it is a primary object of the present invention to provide a reliable, more efficient, less labor-intensive and costly system for separating out chips with holes ("defective" chips) from those without.

Directed to achieving this object, a mechanical pickle chip sorter is herein disclosed. The sorter has a first rotatable cylindrical member and a second rotatable cylindrical member spaced below the first. L-shaped hooks are attached to and extend out from the outer surfaces of both cylindrical members. One leg of the L-shaped hooks extends along lines which are tangent to a radial direction defined by the other leg of the L-shaped hooks. The rotatable cylindrical members or drums are both driven such that the free ends of the tangentially drum extending portions extend in a direction opposite to the direction of drum rotation. In this manner, defective pickle chips which are deposited onto the first rotatable cylindrical member are hooked through their holes by the free ends of the hooks. The second cylindrical member hooks any remaining defective pickle chips which may have passed over the first cylindrical member. The hook members attached to the cylindrical members are configured, sized and positioned such that pickle chips cannot bridge or extend between two adjacent hooks, and thereby not be sorted. Thereby, only and generally all of the defective pickle chips are caught on the hooks. Thus, the remaining chips—the good chips, those without holes—fall off of the cylindrical members onto a first conveyor, and the hooked chips—the defective chips, those with holes—are carried by one or the other of the cylindrical members on their hooks an angular distance generally past the six o'clock position where they gravity fall off onto a second conveyor. The good chips on the first conveyor are conveyed to a pickle chip weighing, bottling and packaging station(s) and the defective chips on the second conveyor are conveyed to a relish processing station.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

DETAILED DESCRIPTION OF PREFERRED EMBODIMENTS

Figure 1:
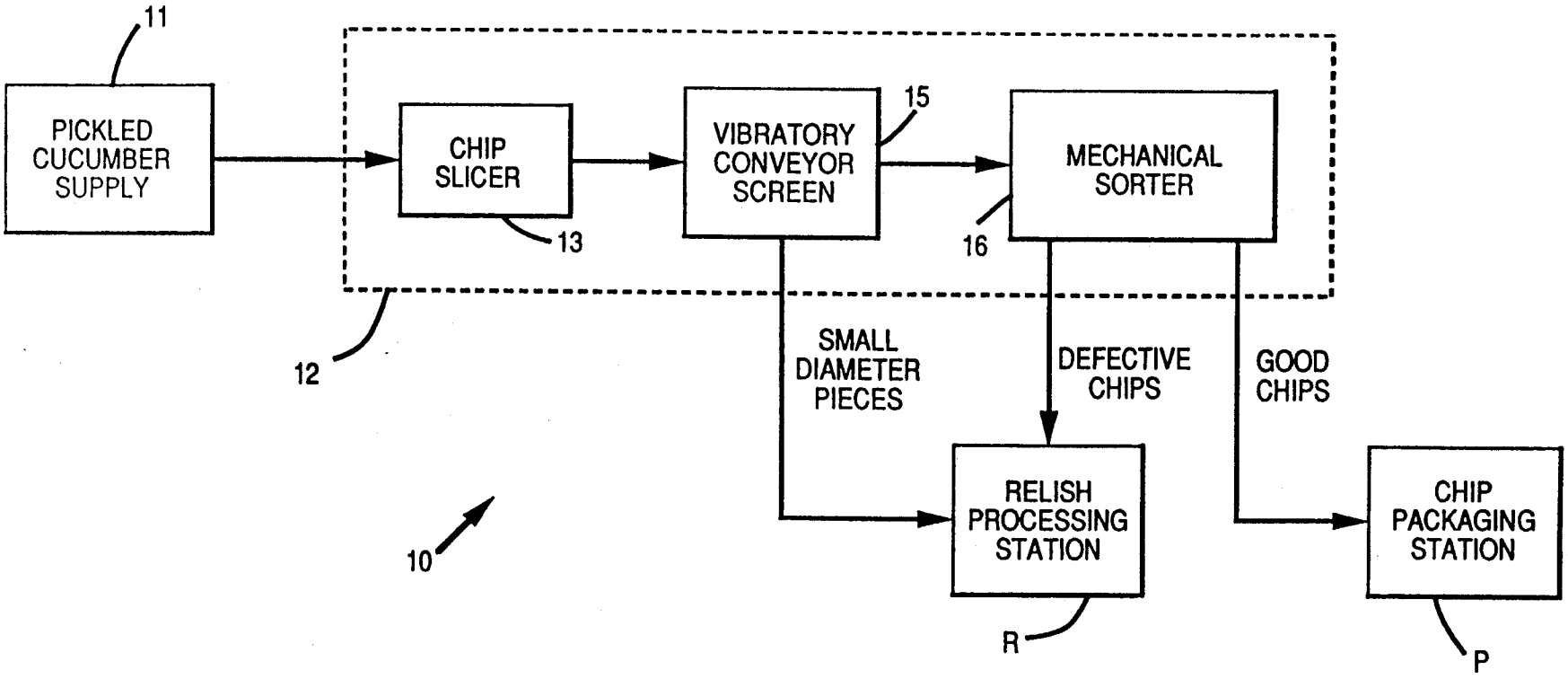
FIG. 1 is a schematic flow chart of a pickle processing system of the present invention.

Referring to FIG. 1, a food processing system of the present invention is shown generally at 10, for processing pickle chips or the like. At the beginning of system 10, pickled cucumbers from a cucumber supply 11 after inspection enter the sorting system shown generally at 12 where they first enter a conventional slicer 13 where they are sliced into chips C. The slicer 13 typically comprises a circular wheel with rectangular blades in it about four inches long and ¾ inch wide, and an example thereof is Urschell's OV Slicer. Chips C are then deposited onto a conventional vibrating conveyor 14, commonly referred to as a shaker bed, which is approximately three feet wide and ten feet long. Vibrating conveyor 14 includes a square wire screen 15, which has a plurality of holes, whose size is in the range of ⅝ to one inch and which are arranged in horizontal rows along the length of the screen. Chips C on screen 15 are caused by the screen to vibrate as they travel down the conveyor 14. The vibration not only helps move the chips C along but also causes them to spread out and separate such that the small butt-ends of the cut up cucumbers pass through the holes or openings of the screen 15 as the chips pass down conveyor 14. The butt-ends are not usable as chips since they are too small and are formed mostly of rind. After passing through the screen holes the butt-ends are conveyed to a station R where they are processed into relish. The chips C then pass to a sorter shown generally at 16.

Figure 9A:
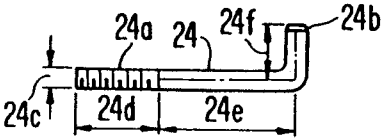
FIGS. 9*a* and 9*b* illustrate in isolation enlarged side views of first and second hooks of the system of FIG. 1.
Figure 9B:
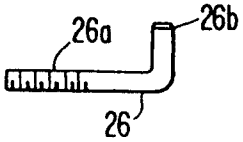
Figure 5:
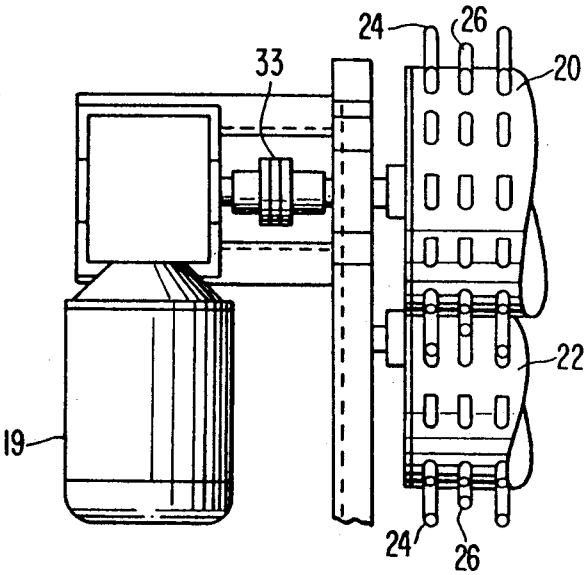
FIG. 5 is a partial top view of the pickle chip sorter system of FIG. 2 showing, for example, the drive motor thereof.

Chips C thus drop from the end of vibrating conveyor 14 onto first rotatable cylindrical member 20 of sorter 16. First rotatable cylindrical member 20 has a plurality of L-shaped hooks 24 and 26 which extend outwardly from the surface thereof. L-shaped hooks 24 and 26 are substantially similar except that hooks 26 are smaller than hooks 24. Referring to FIGS. 9*a* and 9*b*, hooks 24 and 26 have lengths of approximately 2.00 and 1.38 inches, respectively. Further dimensions of hook 24 are 0.156 inch for dimension 24C, $\frac{3}{4}$ for 24*d*, $1\frac{1}{4}$ for 24*e* and $\frac{1}{2}$ for 24*f*. The same dimensions are provided for hook 26 except that 26*e* is $\frac{5}{8}$ inch. The difference in size and the fact that the L-shaped hooks 24 and 26 are alternately attached to the outer circumferential surface of the cylindrical members 22, 24, prevent the chips from bridging across adjacent hooks to thereby escape the hooks.

The second rotatable cylindrical member 22 is positioned below and radially offset from first rotatable cylindrical member 20. As previously mentioned, it also includes a plurality of L-shaped hooks 24 and 26 on its surface. The hooks 24 and 26 can both be of the same size on both of the cylindrical members 20 and 22. L-shaped hooks 24 and 26 include a radially extending portion having threaded ends 24*a*, 26*a* which screw into tapped holes in the outer surfaces of each rotatable cylindrical member or drum. Threaded end 26*a* has a #8-32 thread, for example. Free ends 24*b*, 26*b* then extend tangentially from the radially extending portions of the hooks. The spacing between L-shaped hooks is generally one inch with a total of approximately seven hundred and forty-one hooks for the two cylindrical members being provided. Since the chips are approximately one and a half inch in diameter, the defective ones do not bridge across the hooks and thereby avoid being hooked.

In operation, chips C that fall onto first rotatable cylindrical member 20 are separated based upon whether they have a hole or not. The good chips G are those without holes since they can desirably be used in sandwiches as previously explained. The defective chips D have holes, and thus, while not ideally suited for use in sandwiches, can be used in making relish. Chips D are caused to be hooked through their holes on hook free ends 24*b*, 26*b* since rotatable cylindrical members 20 and 22 are rotated in a direction such that free ends 24*b*, 26*b* extend opposite to the direction of rotation. The hooked defective chips D are carried to and slightly past the bottom or six o'clock position of first rotatable cylindrical member 20 and deposited onto defective chip conveyor 32. The remainder of the chips C are then deposited onto second rotatable cylindrical member 22; they drop off of the first member 20 at approximately the nine o'clock position, that is, before the six o'clock position thereof. One-half inch diameter rubber 32*a* is spiraled around cylindrical members 20, 22 and between hooks 24 and 26 to prevent chips C from sticking to the surface; that is, spiral banding on the drums is provided.

Chips C can stick together, and a defective chip D can effectively be prevented from being hooked by first rotatable cylindrical member 20 if it is stacked or piggybacked on top of another chip. Hence, second rotatable cylindrical member 22 is provided to remove any remaining defective chips D. Good chips G ride over both cylindrical members 20, 22 and are deposited on or drop onto conveyor 30. A divider 31 prevents good chips G and defective chips D from intermingling once separated and after dropping off of the rollers and onto their respective conveyors. Good chips G are carried on conveyor 30 to a chip packaging station P where they are weighed out and packaged in jars, or seven-pound or five-gallon plastic containers, flavoring brine added and the containers sealed for transport to the consumer. Defective chips D are transported to a relish processing station R where they are diced, made into relish and packaged for shipment in a known manner.

Figure 2:
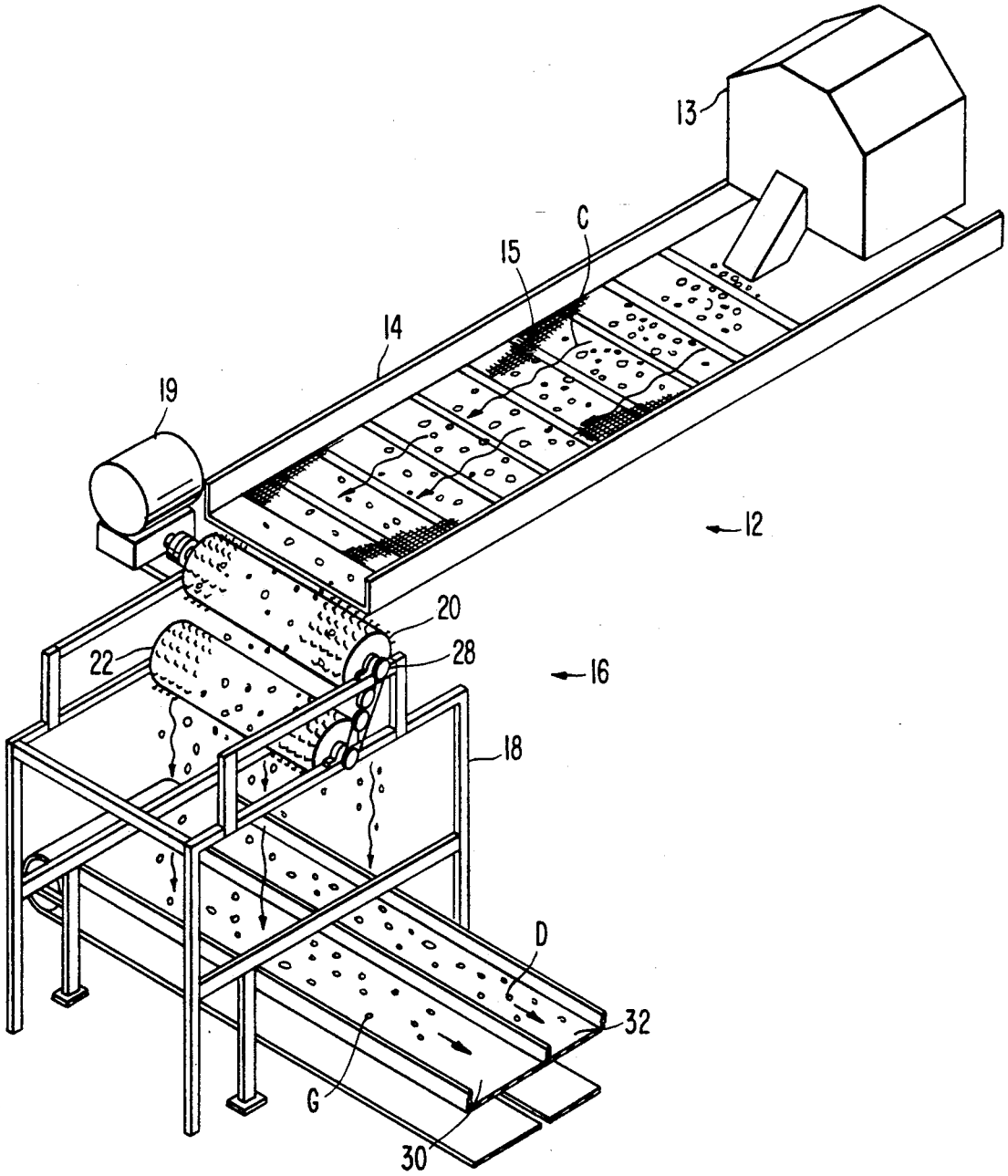
FIG. 2 is a perspective view of a pickle chip sorting system portion of the pickle processing system of FIG. 1.
Figure 3:
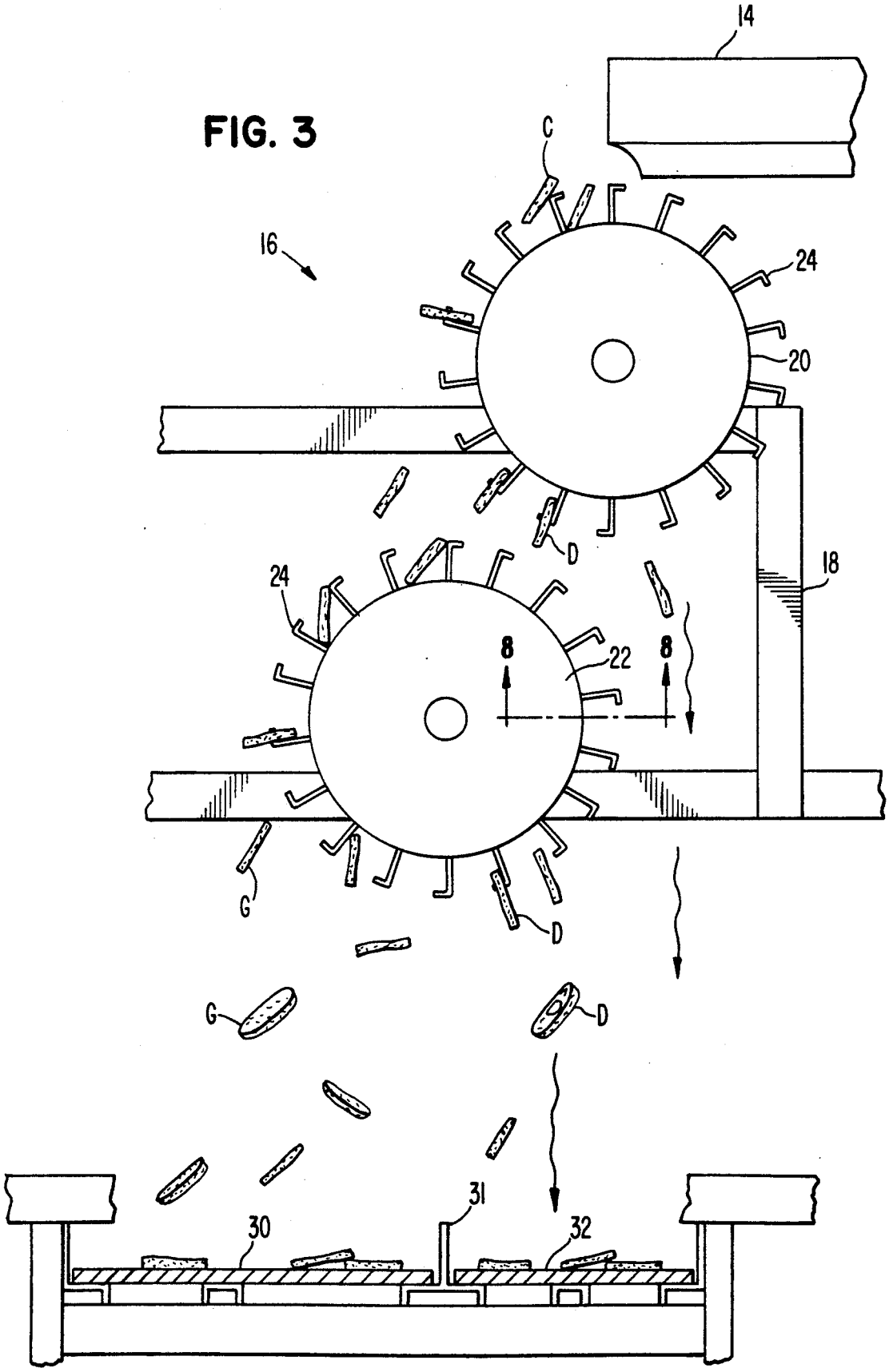
FIG. 3 is an enlarged side view of the left hand portion of the system of FIG. 2.
Figure 4:
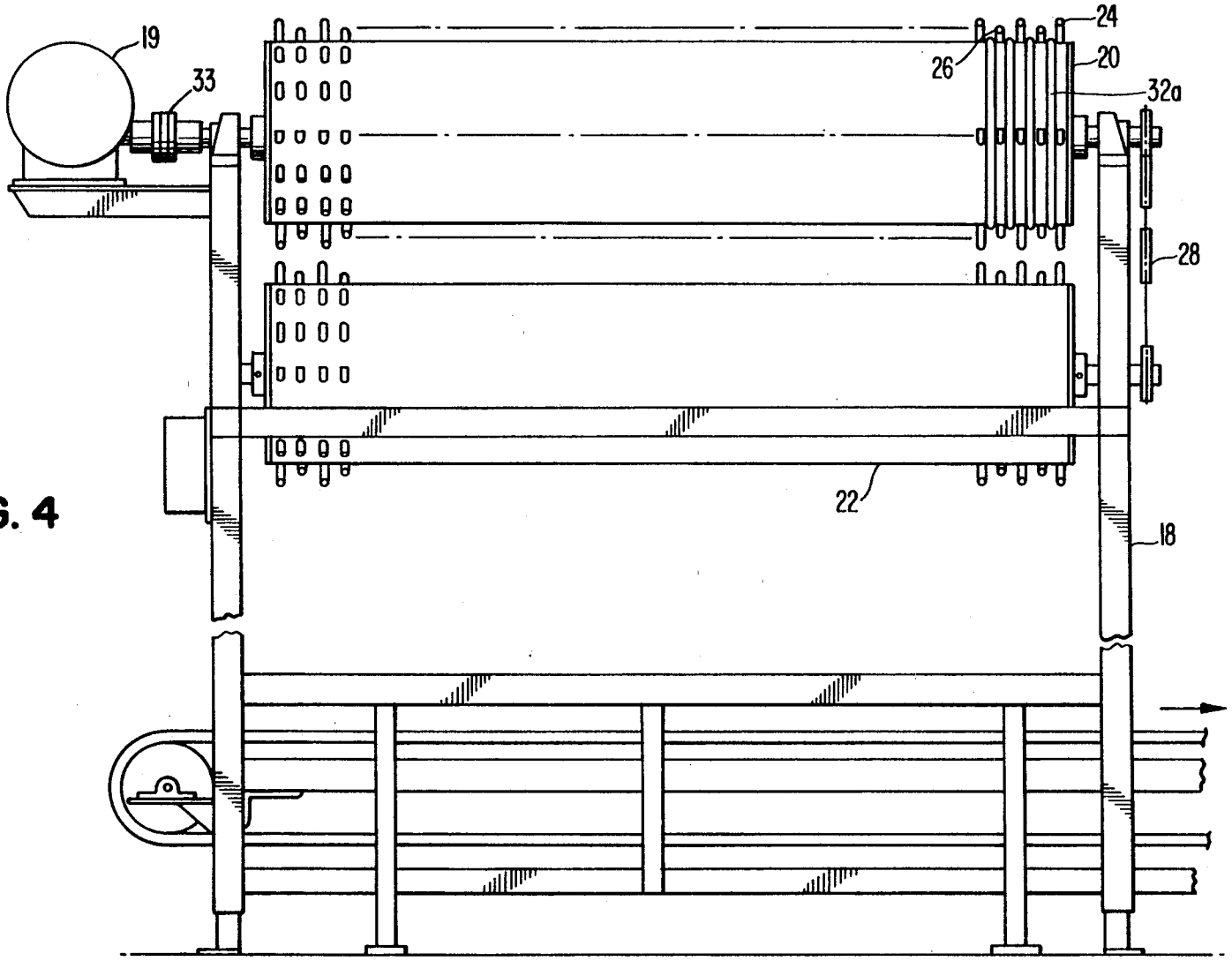
FIG. 4 is a front view of the system portion of FIG. 3.
Figure 7:
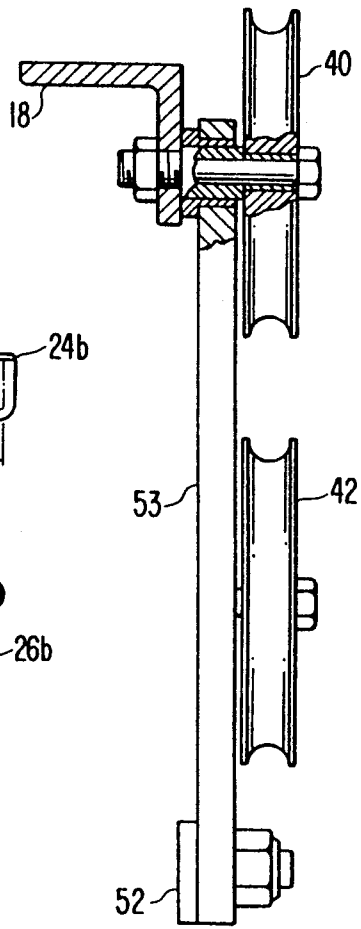
FIG. 7 is a partial front view of the pulleys used in the drive mechanism illustrated in FIG. 6.

Referring to FIGS. 2 and 4, sorter 16 is shown supported on a frame 18, which can be made from angle iron, tubular members or any other suitable structural shape. Frame 18 supports both upper or first cylindrical member 20 and lower or second cylindrical member 22, as well as motor 19. Rotatable cylindrical member 20 is supported on bearings 38. Motor 19 is coupled by a coupling 33 to first cylindrical member 20 at one end thereof. Motor 19 comprises a variable speed DC motor and gear reducer which causes cylindrical member 20 to rotate in a first direction, which is opposite to the direction in which free ends 24*b*, 26*b* point. A drive mechanism 28 is attached to rotatable cylindrical member 20 on an end opposite to the end attached to motor 19, and connects first rotatable cylindrical member 20 to second rotatable cylindrical member 22. Second rotatable cylindrical member 22 is also supported on bearings 46. A first pulley 36 is attached to first cylindrical member 20 and take-up pulleys 40 and 42 are positioned between a pulley 44 attached to second cylindrical member 22. A belt or chain is connected between pulleys 36, 40, 42 and 44 to thereby form the drive mechanism 28.

An adjustment assembly 50 is connected to take-up pulleys 40 and 42 to allow the horizontal position of the rotatable cylindrical members 20, 22 to be varied. Thus, errors in alignment between vibrating conveyor 14 and the split conveyors 30, 32 can be corrected by adjusting the relative positions of the rotatable cylindrical members. Adjustments in the position of take-up pulleys 40 and 42 are made by telescoping link 52 with respect to link 51, which is attached to frame 18. A slot and pin arrangement limits the amount of telescoping of link 52 within link 51. As link 52 telescopes, link 53 which is attached to one end of link 52 pivots about a point attached to frame 18. Link 53 has pulleys 40 and 42 rotatably fixed thereon by bolts, for example.

Figure 8:
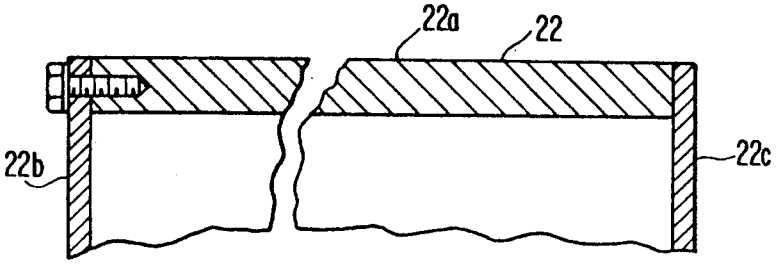
FIG. 8 is an enlarged sectional view taken along line 8—8 in FIG. 3, showing a rotatable cylindrical member of the system of FIG. 1 but with the L-shaped hooks thereof omitted for illustrative purposes.
Figure 6:
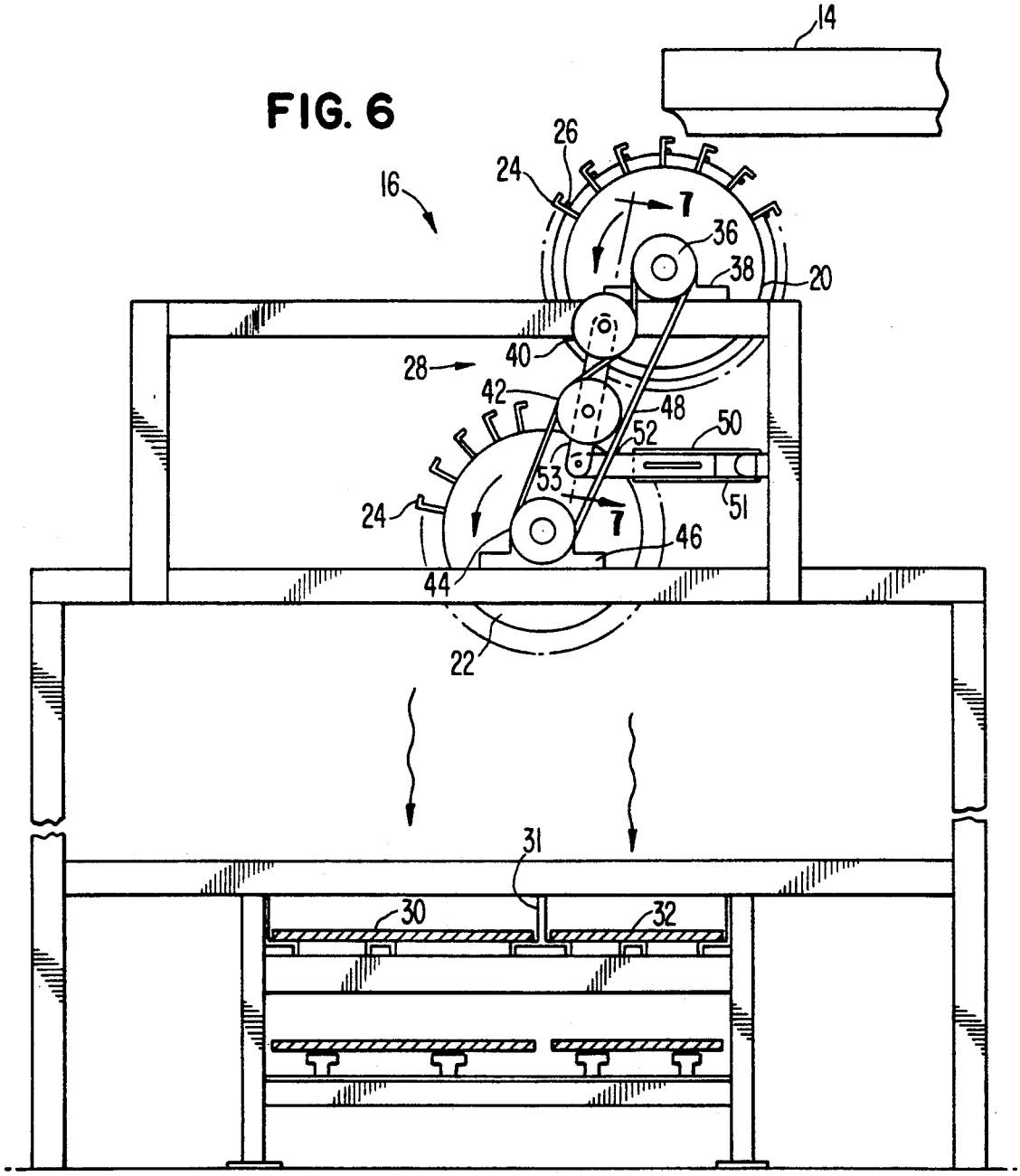
FIG. 6 is a side view of the system of FIG. 2.

FIG. 8 shows a sectional view through second cylindrical member 22. It is seen therein that the second rotatable cylindrical member 22 is formed as a hollow drum having an outer cylindrical wall 22*a* and two end plates 22*b* and 22*c* bolted to the wall. This tubular structure can be formed of stainless steel or plastic, or similar material which can be cleansed and kept sanitary. First cylindrical member 20 is constructed in a manner similar to that of the second cylindrical member 22.

By way of example, a typical prior art shaker bed with manual sorting has a conveying speed of about thirty feet per minute. In contrast, with the present invention, shaker bed speeds of eighty feet per minute are possible. The system 10 packages nine thousand pounds of chips per hour, by way of example, and represents a labor reduction of two workers who previously were needed to hand sort out the defective chips. The speed of rotation of first and second rotatable cylindrical members can be varied from between one hundred and two hundred and fifty revolutions per minute to accommodate different conditions. It is envisioned that the directions of rotation for each cylindrical member can be different and that only one or three or even more cylindrical members can be employed, as needed.

The present invention has been described in detail with reference to the above description and the accompanying drawings. However, the claimed invention is not limited to the disclosure which is merely illustrative. For example, the present sorting system can be used for sorting items other than pickle chips and which have holes, such as onion rings, or for sorting two very different types of items, one of which is more likely to be caught up on rotating hooks than the other. The claims annexed hereto and forming a part hereof define the scope of protection sought.

What is claimed is:

1. For separating items with holes from those without holes, a mechanical sorter comprising:

a first rotatable member having a plurality of hooks attached to an outer surface thereof, each said hook having a radially extending portion and a tangentially extending portion having a free hook end;

a second rotatable member, spaced from said first rotatable member and having a plurality of hooks attached to an outer surface thereof, each said hook having a radially extending portion and a tangentially extending portion having a free hook end;

a first conveyor;

a second conveyor; and drive means for driving said first and second rotatable members so that both rotate in a predetermined direction with said free ends of both said hooks pointing in a direction opposite to the directions of rotation, such that when items with holes and items without holes are deposited onto said first member, said free hook ends of said first member hook into the holes of at least some of the items with holes and the remaining items drop onto said second member where at least most of the items with holes dropping thereon are hooked on said free hook ends of said second member and the remaining items dropped thereon drop onto said first conveyor, wherein the items hooked on said hooks of said first and second members are deposited on said second conveyor.

2. The mechanical sorter of claim 1 further comprising vibratory conveyor means for conveying the items to said first member.

3. The mechanical sorter of claim 1 wherein said first and second conveyors form a split discharge conveyor system.

4. The mechanical sorter of claim 1 wherein said first conveyor conveys the items thereon to an item processing first station and said second conveyor conveys the items thereon to an item processing second station different from the first station.

5. The mechanical sorter of claim 1 wherein said second rotatable member is spaced laterally from and below and generally parallel to said first rotatable member.

6. The mechanical sorter of claim 1 wherein said drive means comprises motor-driven drive pulley means for rotating said first and second members simultaneously and in the same direction.

7. The mechanical sorter of claim 1 wherein said plurality of hooks includes hooks of at least two different heights, and wherein said hooks of different heights are alternatingly spaced on the surfaces of said first and second rotatable members.

8. A system for separating pickle chips with holes from those without, said system comprising:

a pickle chip slicer;

a mechanical separator; and conveyor means for conveying a mass of pickle chips from said pickle chip slicer to said separator;

wherein said separator includes a plurality of rotatary hook means for hooking chips with holes and transporting them by said hook means to a first location, while chips without holes are not hooked by said hook means and thereby are transported to a second location.

9. The system of claim 8 wherein said conveyor means includes a vibratory conveyor.

10. The system of claim 8 wherein said separator includes a rotating drum out from which said hook means extends.

11. The system of claim 8 wherein said separator comprises at least one rotatable cylindrical member including a plurality of said hook means attached to the outer surface of said cylindrical member and rotating means for rotating said cylindrical member in a direction such that the free ends of said hook means point in a direction opposite to the direction of rotation.

12. The system of claim 11 wherein said hook means include hooks of at least two different heights, and wherein said hooks of different height are alternately spaced apart within rows such that the pickle chips cannot bridge across said hook means.

13. The system of claim 8 wherein said hook means include hooks of at least two different heights, and wherein said hooks of different height are alternately spaced apart within rows such that the chips cannot bridge across said hook means.

14. The system of claim 8 further comprising split conveyor means for transporting the unhooked chips to the second location and the hooked chips to the first location.

15. The system of claim 8 further comprising a pickle chip packaging station at the second location.

16. The system of claim 15 further comprising a relish processing station at the first location.

17. A method of separating pickle chips, said method comprising the steps of:

conveying a mass of pickle chips, some with and some without holes, to a separator station;

at the separator station, separating from the mass pickle chips by hooking pickle chips with holes through their holes and transporting the pickle chips with holes to a first location; and transporting the remaining unhooked pickle chips, which are generally and substantially free of holes, to a second location.

18. The method of claim 17 wherein said conveying step includes conveying the mass of pickle chips on a vibrating conveyor.

19. The method of claim 17 wherein the separator station comprises at least one rotatable drum having attached to an outer surface thereof hook means for hooking said pickle chips with holes, and wherein said separating step further comprises rotating said drum in one direction with the free ends of said hook means extending generally in the other direction.

20. The method of claim 19 wherein said separating step includes preventing the pickle chips from bridging said hook means by utilizing hooks of at least two different heights and alternately arranging the hooks of different heights within rows.

21. The method of claim 17 wherein the pickle chips are transported to the first and second locations by a split conveyor, and further comprising processing the pickle chips at the first location into relish and bottling the pickle chips at the second location.

22. The method of claim 17 wherein said separating step includes depositing the pickle chips on a rotating hook-covered drum.

23. A method of processing pickle chips, said method comprising the steps of:

conveying pickle chips, some having substantial through holes and some not having them, down onto a rotatable assembly having a plurality of projecting hooks thereon;

rotating the rotating assembly such that the chips without substantial through holes conveyed thereon fall off of the assembly generally before the six o'clock position thereof to a first location and at least some of the chips with substantial through holes conveyed thereon are hooked on the hooks and gravity drop thereoff, generally after the six o'clock position thereof, to a different second location; and packaging the chips dropping onto the first location as pickle chips.

24. The method of claim 23 further comprising processing the chips dropping onto the second location into relish.

* * * * *